United States Patent [19]

Baader

[11] 4,365,123

[45] Dec. 21, 1982

[54] SNAP SWITCH AS WELL AS A METHOD FOR ITS MANUFACTURE

[76] Inventor: Helmut Baader, Birkenweg 6, D-8470 Nabburg, Fed. Rep. of Germany

[21] Appl. No.: 214,949

[22] Filed: Dec. 10, 1980

[51] Int. Cl.[3] ..... H01H 21/04

[52] U.S. Cl. ..... 200/67 DA; 200/83 P; 200/67 D

[58] Field of Search ..... 200/67 DA, 67 D, 251, 200/246, 835 P, 835 A

[56] References Cited

U.S. PATENT DOCUMENTS

| | | | |
|---|---|---|---|
| 2,374,986 | 5/1945 | Fetter | 200/67 DA |
| 2,700,079 | 1/1955 | Haydon | 200/67 DA |
| 2,773,955 | 12/1956 | Haydon et al. | 200/67 DA |
| 3,662,132 | 5/1972 | Good | 200/67 D |
| 4,050,046 | 9/1977 | Wilson | 200/67 R |
| 4,168,412 | 9/1979 | Smith | 200/67 DA |

FOREIGN PATENT DOCUMENTS

| | | |
|---|---|---|
| 26449 | 4/1981 | European Pat. Off. . |
| P 603 Gm | 2/1966 | Fed. Rep. of Germany . |
| 2819795 | 11/1979 | Fed. Rep. of Germany . |

*Primary Examiner*—Willis Little

*Attorney, Agent, or Firm*—Karl W. Flocks; A. Fred Starobin

[57] ABSTRACT

The present invention concerns a snap switch comprising:

- a snap spring, which is fastened on a spring mount and carries at least one switching contact spaced therefrom,
- at least one contact stationary with respect to the spring mount, on which the switching contact lies in one switching position of the snap spring,
- a guide rod, which is pivotally mounted near the spring mount and is connected with said snap spring at a distance from its mounting as well as from the stationary contact and exhibits a point of application for an actuating force.
- a prestress spring, which acts on the guide rod and strives to keep this in a stop position with prestress, and an adjusting member for adjusting the prestress of said prestress spring.

4 Claims, 8 Drawing Figures

SNAP SWITCH AS WELL AS A METHOD FOR ITS MANUFACTURE

BACKGROUND OF THE INVENTION

Snap switches are frequently used in electrical engineering in order to assure that switching over of electrical contacts take place abruptly, as soon as an arbitrarily slow variable input variable has reached a certain critical value. Abrupt switchings over are necessary in order to avoid contact burning and to achieve sure contact. Frequently, for example in the case of membrane pressure switches, the input variable is a force which must overcome an adjustable prestress in order to bring about switching over of the snap switch.

With a known snap switch of the described type, the prestress spring is a helical pressure spring which is supported on the one hand on an adjusting screw and on the other hand presses directly against the guide rod. The guide rod is mounted on a physically formed axis, which is fixed in such a way that the guide rod solely transmits switching forces to the snap spring, but relieves this of transverse forces. This applies for the transverse force components of the actuating force acting on the guide rod as well as for the transverse force components which can be transmitted from the prestress spring to the guide rod. A non-rotatable intermediate member is arranged between the helical spring and the adjusting screw, which intermediate member should prevent turning the helical spring along when the adjusting screw is turned to adjust the snap switch. Thus, the helical spring is prevented from building up a torsion stress, which torsion stress would be first maintained by static friction, but would sooner or later be released due to vibrations of the snap switch, due to which the prestress acting on the guide rod, and thus the entire switching characteristic of the snap switch would change by an amount which is not predetermined.

Despite these measures—on the one hand relieving the snap spring of transverse forces, which could change the snapping over behavior, and on the other hand efforts to keep the prestress force constant—it is difficult with known snap springs of the described type and, it is possible, if at all, only with great manufacturing-technical effort, to guarantee over the long run that a switching over process takes place when and only when the input variable reaches or exceeds a critical value predetermined with narrow tolerances. On the other hand, these difficulties are due to the fact that the position of the helical spring with respect to the guide rod is not sufficiently definable and due to this it cannot be ruled out that with adjusting of the known snap switch, certain stresses are maintained in the helical spring due to static friction only and are later released due to vibrations. Consequently, the position of the spring axis can change with relation to the rotational axis of the guide rod, which results in a corresponding change of the torque exerted by the helical pressure spring on the guide rod. On the other hand, the magnitude of bearing friction, which resists the swivelling of the guide rod, is dependent with the described known snap switches on manufacturing tolerances, accidental shifts of the guide rod along its axis as well as bearing corrosion possibly occurring in the course of time, and therefore cannot be taken into account in advance over a long period of time with the adjustment of the snap switch.

SUMMARY OF THE INVENTION

It is thus an object of the present invention to design a snap switch of the type described at the outset with manufacturing technical simple means, in such a way that the magnitude of the critical input force required for switching over which is set with the original adjustment is maintained over a practically unlimited time with great accuracy.

This object is met according to the invention in that said prestress spring is a leaf spring fastened on the one hand on said guide rod and on the other hand on a lever, said lever being fixed in a stationary support near said spring support and adapted to be swivel-adjusted by means of said adjusting member.

According to the present invention, therefore, the prestress spring serves at the same time as a support for the guide rod, by means of which this is kept free from external bearing friction. The internal friction within a leaf spring of the type and size of interest here is negligibly small. Due to the fact that the prestress spring is fastened on the guide rod on the one hand and said lever on the other, in order to be able to transmit bending moments from the lever to the guide rod, a shift between the prestress spring and the component parts between which said spring is clamped is ruled out in operation, so that nothing can be lost subsequently from the originally adjusted prestress. Losses in spring stress due to fatigue can be eliminated by suitable dimensioning of the prestress springs in the case of the snap switch according to the invention at least equally well as with known snap switches of the described type. Thus, by means of the present invention, a snap switch is created, which maintains its original setting much more accurately and much more reliably even in large series production, than known snap switches of the described type. The snap switch according to the invention is also largely insensitive to corrosion, because its operational accuracy is not influenced by bearing friction. The friction in the bearing of said lever is without significance for the operating accuracy of the snap switch, since it occurs only with adjustments and later the lever is no longer moved.

For the purposes of the present invention it is not important how the adjusting member is designed. Thus, for example a rotatable cam or a wedge could be used as adjusting member. However, generally, for reasons of manufacturing-technical simplicity, an adjusting member is to be preferred in a form of a screw, as it is provided as a constructional element, even though in a different arrangement, also with the known described snap switch.

It can be advantageous if more than one prestress spring is provided. In the case of one preferred embodiment of the invention, the guide rod and the adjustment lever are connected with each other by a pair of leaf springs arranged on both sides of the snap spring. In this way we have an especially accurate mounting of the guide rod, which is especially resistant against transverse forces.

This embodiment is preferably developed further in that the leaf springs are welded together with flanges, which project sidewards from the guide rod and from the correspondingly designed lever, said guide rod and said lever being U-shaped in cross section, the snap spring being arranged within these U-shaped cross sections.

The snap switch according to the invention can be manufactured according to another feature of the invention by stamping said guide rod and said lever from sheet metal in such a manner that they are interconnected by a bridge member, whereupon the leaf spring or leaf springs are welded together with said guide rod and said lever, and only thereafter is the bridge member removed. Due to this, the interval between the guide rod and the lever determined in the stamping tool is maintained unchanged, and this interval also determines the bending characteristic of the leaf spring or leaf springs. Thus, a particularly accurate arrangement of the welding connections between each leaf spring and the guide rod on the one hand as well as the lever on the other hand is not crucial.

An exemplifying embodiment of the invention will now be described in more details by means of schematic drawings.

DESCRIPTION OF THE PREFERRED EMBODIMENT

Figure 1:
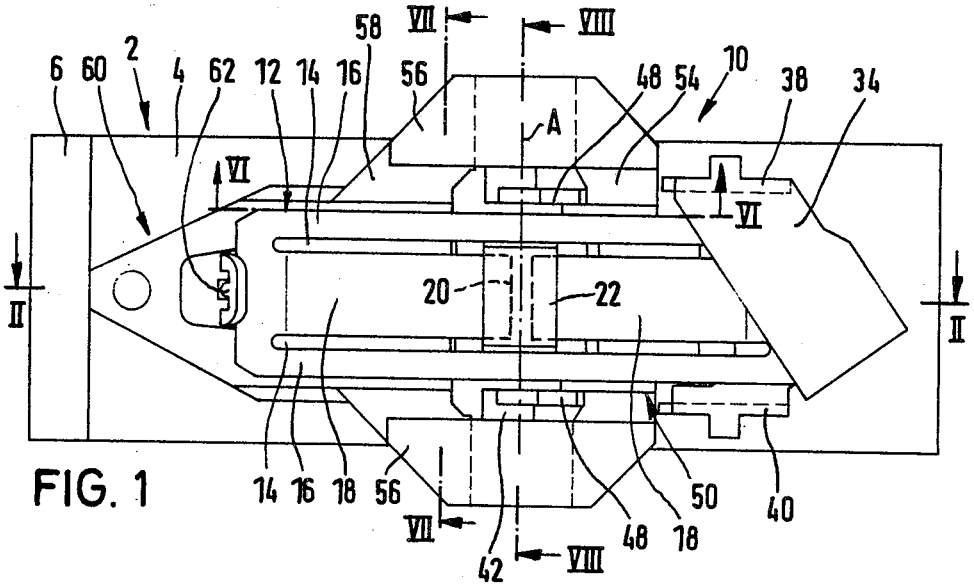
FIG. 1 shows a top view of a snap switch according to the invention.

Parts of a housing 2 are shown in the drawings which consists of electrically insulating plastic and has a base 4 as well as an outside wall 6. A snap switch 10 is mounted in the housing 2.

The electrically conductive component parts of the snap switch 10 include a snap spring 12 in the form of a rectangular leaf spring with two parallel lengthwise slits 14 defining a pair of outer legs 16 in such a way that they are interconnected only at both their ends and by a middle part of the snap spring 12. The middle part consists of two middle legs 18 separated from each other by an interruption 20. Both lengthwise slits 14 are connected with each other in their middle by said interruption 20, so that the result is an H-shaped recess.

Both middle legs 18 of the snap spring 12 separated from each other by the interruption 20 are clamped between a metal cover plate 22 and a metal spring support 24 and welded to them in such a way that the overall length of both middle legs 18 and of the section of the cover plate 22 and spring support 24 bridging over the interruption 20 is greater than the length of each of said outer legs 16. Both middle legs 18 consequently cannot lie in a common plane with the outer legs 16, but form either an upward wiggle with relation to the outer legs 16, then a downward one and finally again an upward arched wiggle (FIGS. 2 and 4) or an upward arched arc with relation to both outer legs (FIGS. 3 and 5). The snap spring 12 fastened on the spring support 24 is thus bistable. It can jump back and forth between a first switching position (FIGS. 2 and 4) and a second switching position (FIGS. 3 and 5) under the effect of an outer force only.

The spring support 24 is fastened on the housing base 4 and exhibits a soldering lug 26 projecting outwardly therethrough.

Other electrically conductive component parts of the snap switch 10 are two stationary contacts 28 and 30 fastened opposite each other and each on a contact support 34 and 36, respectively, on both sides of a double sided switching contact 32 fastened on the snap spring 12. The contact supports 34 and 36 are fastened on the base of the housing 4 and likewise each have a soldering lug 38 and 40 projecting therethrough.

Figure 2:
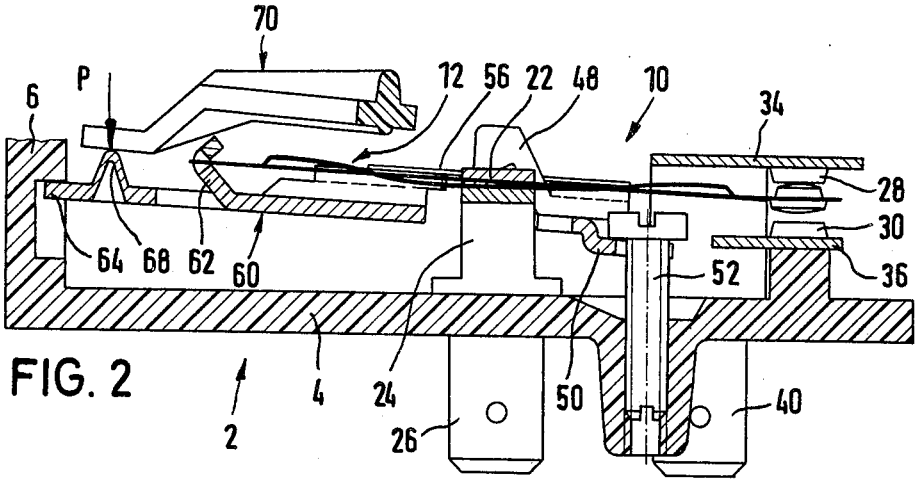
FIG. 2 shows the cross section II—II in FIG. 1, wherein the snap switch adjusted with a small prestress force is shown in a first switching position.
Figure 3:
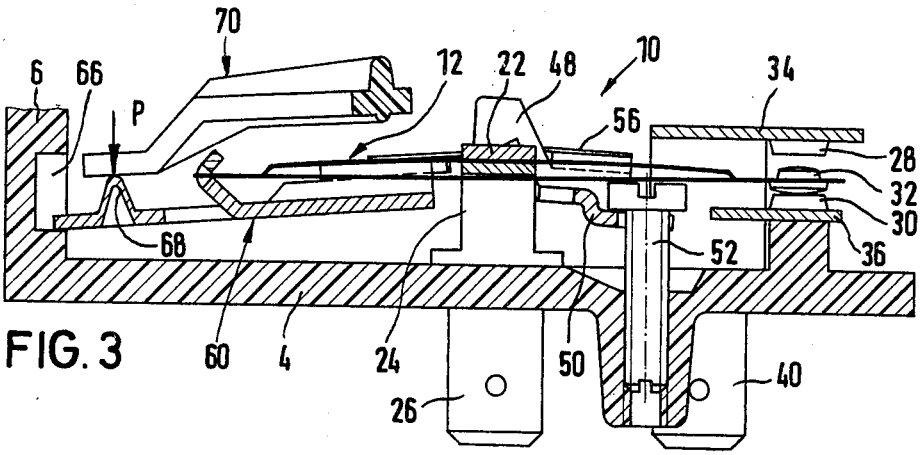
FIG. 3 shows a cross section of the snap switch according to FIG. 2 with the same adjustment, however, in a second switching position.
Figure 4:
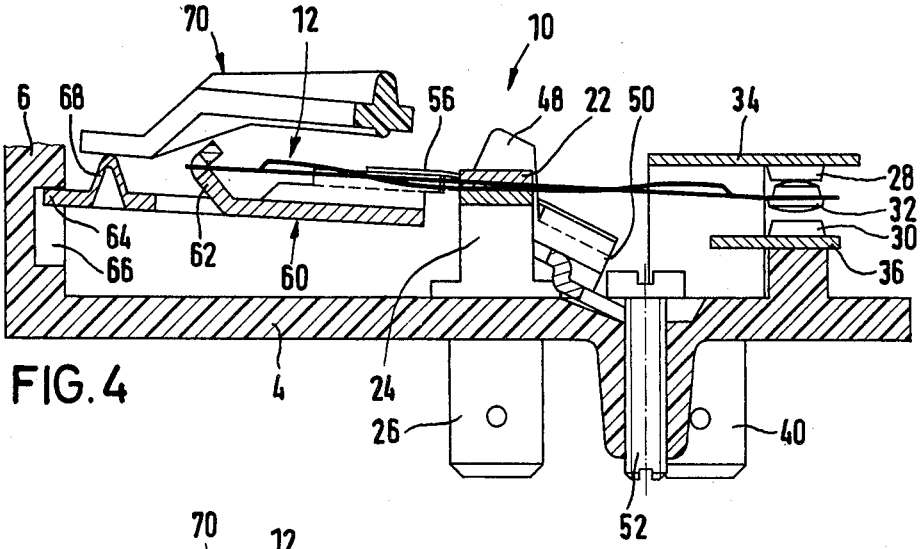
FIG. 4 shows a cross section similar to FIG. 2 of the same snap switch which is likewise shown in its original switching position, however, it is adjusted here with greatest possible prestress.
Figure 5:
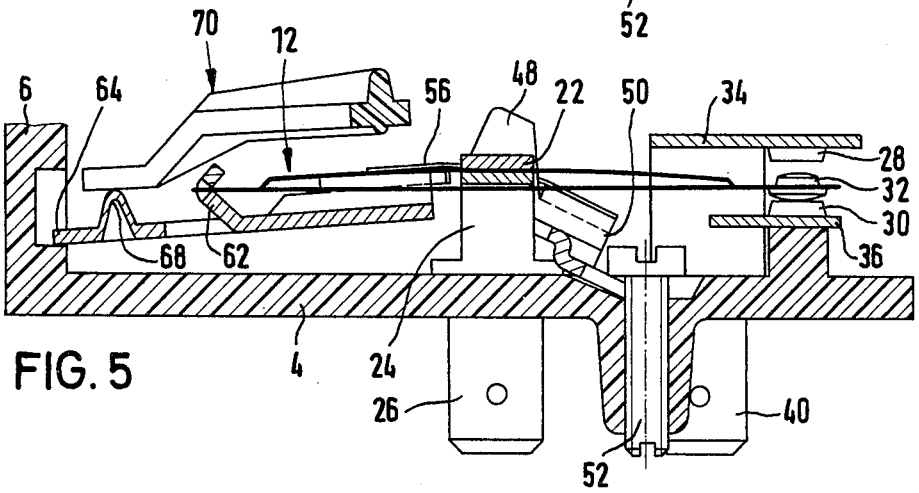
FIG. 5 shows the snap switch in its second switching position adjusted with the greatest possible prestress.
Figure 6:
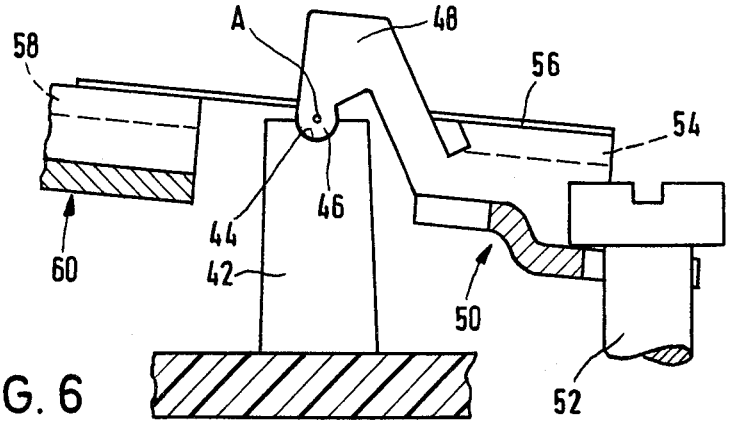
FIG. 6 shows cross section VI—VI in FIG. 1.
Figure 7:
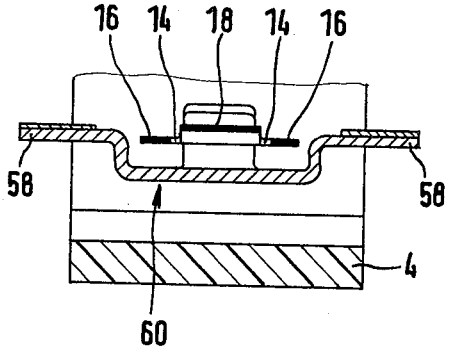
FIG. 7 shows cross section VII—VII in FIG. 1
Figure 8:
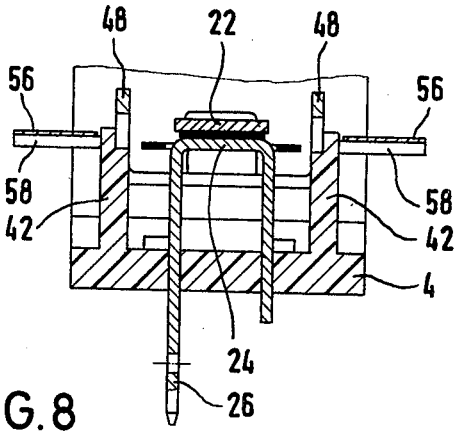
FIG. 8 shows cross section VIII—VIII in FIG. 1.

Thus, the snap switch 10 connects the soldering lugs 26 and 38 with each other when the snap spring 12 assumes its first switching position which is the upper position as shown in FIGS. 2 and 4, whereas the soldering lugs 26 and 40 are connected with each other when the snap spring assumes its second switching position which is the lower position according to FIGS. 3 and 5.

The snap spring 12 shown here corresponds to the one shown and described in Applicant's U.S. patent application Ser. No. 36,104, said prior application also disclosing other examples of snap springs which, in addition to other previously known snap springs, are suitable for the present snap switch 10.

One bearing block 42 is arranged on each side of spring support 24 integral with the housing 2 and exhibits a joint or fulcrum seat 44. The fulcrum seats 44 take up two joint heads 46, which are each formed on a hook-like part 48 of a lever 50. The lever 50 is therefore swivellable about a stationary axis A, which extends through the centers of both fulcrum seats 44.

Lever 50 embraces the spring support 24 with sufficient clearance with both its hook-like parts 48, so that it can be swivel adjusted in a wide angular range about axis A. To adjust the lever 50, there is an adjusting member 52 in the form of a cap screw, which engages the end of lever 50 remote from axis A, and is screwed in the housing base 4.

In the area between its hook-like parts 48 and the adjusting member 52, the lever 50 has a U-shaped cross section with two flanges 54, which project laterally in a plane parallel to axis A. Two prestress springs in the form of leaf springs 56 are welded to both flanges 54 and extend in the same lengthwise direction as the snap spring 12, on either side thereof. While the snap spring 12 extends between both bearing blocks 42, both leaf springs 56 are arranged outside of the bearing blocks.

Both leaf springs 56 are welded to a flange 58 each of a guide rod 60, likewise said flanges extending parallel to axis A. Thus, the two leaf springs 56 in common form a support enabling the guide rod 60 to pivot about axis A, but excluding any other movement thereof. The axis A is at the same time the transverse middle line of the snap spring 12.

A hook 62 is formed on guide rod 60, on which the end of the snap spring 12 remote from the switching contact 32 and lever 50 is connected. The end 64 of guide rod 60 remote from lever 50 itself projects into a recess 66 of the housing 2, whose upper and lower limit form a stop for guide rod 60. Between the hook 62 and the end 64, a conical point of application 68 is formed on guide rod 60 for an arm 70 of an actuating member.

According to whether the adjusting member 52 is screwed more or less deep into the housing base 4, the end 64 of the guide rod 60 lies in rest position of the snap switch 10, with a more or less large prestress on the upper boundary of recess 66 (FIG. 2 and 4). If, however, the arm 70 exerts a force P on the point of application 68, which force is directed downward in the drawings and exceeds a certain amount corresponding to said prestress, then this force P forces guide rod 60 into its lower stop position (FIGS. 3 and 5), and on the way there, the snap spring 12 snaps over abruptly so that its switching contact 32 which originally lay on the upper stationary contact 28, abruptly rebases itself therefrom and is lain on the lower stationary contact 30.

What is claimed is:

1. A snap switch comprising a snap spring, which is fastened on a spring support and bears at least one switching contact spaced therefrom, at least one contact stationary with respect to the spring support, on which the switching contact lies in the switching position of the snap spring, a guide rod, which is pivotally mounted near the spring support and is connected with said snap spring at a distance from said spring support as well as from the switching contact, and exhibits a point of application for an actuating force, at least one prestress spring, which acts on the guide rod and strives to keep this in stop position with prestress, an adjusting member for adjusting the prestress of said prestress spring wherein said prestress spring is a leaf spring on the one hand fastened on said guide rod and on the other hand on a lever, said lever being mounted near the spring support in a stationary support and adapted to be swivel adjusted by means of said adjusting member.

2. The snap switch as claimed in claim 1, wherein said guide rod and lever are interconnected by means of a pair of leaf springs arranged on both sides of said snap spring.

3. The snap switch as claimed in claim 2 wherein said leaf springs are welded to flanges which project laterally from the guide rod and from said lever, said guide rod and said lever being U-shaped in cross section and said snap spring being arranged within said U-shaped cross sections.

4. A method for manufacturing a snap switch having at least one leaf spring fastened on one hand on a guide rod and on the other hand on a lever comprising the steps of stamping the guide rod and the lever out of sheet metal in a manner that they are interconnected by a bridge member, welding the leaf spring or leaf springs to the guide rod and the lever, thereafter removing said bridge member.

* * * * *